US007770690B2

(12) United States Patent
Schorn et al.

(10) Patent No.: US 7,770,690 B2
(45) Date of Patent: Aug. 10, 2010

(54) DOUBLE-FLOW EXHAUST SYSTEM FOR AN INTERNAL-COMBUSTION ENGINE

(75) Inventors: Juergen Schorn, Rutesheim (DE); Michael Wessels, Weissach (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 539 days.

(21) Appl. No.: 10/588,027

(22) PCT Filed: Mar. 15, 2005

(86) PCT No.: PCT/EP2005/002727

§ 371 (c)(1),
(2), (4) Date: Aug. 2, 2006

(87) PCT Pub. No.: WO2005/113955

PCT Pub. Date: Dec. 1, 2005

(65) Prior Publication Data

US 2009/0020359 A1 Jan. 22, 2009

(30) Foreign Application Priority Data

May 7, 2004 (DE) ..... 10 2004 022 721

(51) Int. Cl.
*F01N 13/08* (2010.01)

(52) U.S. Cl. ..... 181/228; 181/270; 181/275; 181/272; 181/212; 181/227; 180/309; 180/68.3; 180/296; 60/299; D12/194

(58) Field of Classification Search ..... 181/270, 181/275, 272, 228, 212, 227, 232; 180/309, 180/68.3, 296; 60/299; D12/194
See application file for complete search history.

(56) References Cited

U.S. PATENT DOCUMENTS

| | | | | | |
|---|---|---|---|---|---|
| D159,865 | S | * | 8/1950 | Russell | D12/194 |
| 2,909,235 | A | * | 10/1959 | Beranek | 181/252 |
| 3,749,199 | A | * | 7/1973 | Weber | 181/236 |
| 4,354,349 | A | * | 10/1982 | Otani et al. | 60/299 |
| 4,689,952 | A | * | 9/1987 | Arthur et al. | 60/313 |
| 5,265,420 | A | * | 11/1993 | Rutschmann | 60/302 |
| 5,325,666 | A | * | 7/1994 | Rutschmann | 60/302 |
| 5,388,408 | A | * | 2/1995 | Lawrence | 60/324 |
| 5,775,100 | A | * | 7/1998 | Sloss et al. | 60/299 |

(Continued)

FOREIGN PATENT DOCUMENTS

DE 3241750 A1 * 5/1984

(Continued)

OTHER PUBLICATIONS

International Search Report dated Jun. 23, 2005 including English Translation of relevant portion and PCT/ISA/237 (Seven (7) pages).

*Primary Examiner*—Jeffrey Donels
*Assistant Examiner*—Forrest M Phillips
(74) *Attorney, Agent, or Firm*—RatnerPrestia

(57) ABSTRACT

A double-flow exhaust system for an internal-combustion engine, having exhaust-gas-carrying pipes and at least one muffler and catalyst housing. A separate end muffler is provided for each exhaust line, on which the end mufflers are both fluidically connected by at least one preferably mountable connection pipe.

7 Claims, 3 Drawing Sheets

U.S. PATENT DOCUMENTS

| | | | | |
|---|---|---|---|---|
| 5,907,134 | A * | 5/1999 | Nording et al. | 181/228 |
| 6,106,344 | A * | 8/2000 | Mashiko | 440/89 R |
| 6,141,958 | A * | 11/2000 | Voss | 60/272 |
| 6,209,318 | B1 * | 4/2001 | Rutschmann | 60/313 |
| 6,346,019 | B1 | 2/2002 | Nanami | |
| 6,412,587 | B1 * | 7/2002 | Weimert et al. | 180/309 |
| 6,651,773 | B1 * | 11/2003 | Marocco | 181/270 |
| 6,935,461 | B2 * | 8/2005 | Marocco | 181/270 |
| 7,281,606 | B2 * | 10/2007 | Marocco | 181/270 |
| D581,335 | S * | 11/2008 | Contreras | D12/194 |
| 2003/0079938 | A1 * | 5/2003 | Yamaguchi | 181/227 |
| 2003/0116378 | A1 * | 6/2003 | Cathcart et al. | 181/240 |
| 2004/0050618 | A1 * | 3/2004 | Marocco | 181/248 |
| 2007/0220872 | A1 * | 9/2007 | Weimert et al. | 60/299 |
| 2007/0284186 | A1 * | 12/2007 | Thayer et al. | 181/232 |

FOREIGN PATENT DOCUMENTS

| | | | |
|---|---|---|---|
| DE | 199 32 349 | A1 | 1/2001 |
| DE | 201 15 656 | U1 | 2/2002 |
| JP | 54145825 | A * | 11/1979 |

* cited by examiner

DOUBLE-FLOW EXHAUST SYSTEM FOR AN INTERNAL-COMBUSTION ENGINE

This application is a National Phase of PCT/EP2005/002727, filed Mar. 15, 2005, and claims the priority of DE 10 2004 022 721.7, filed May 7, 2004, the disclosure of which is expressly incorporated by reference herein.

BACKGROUND AND SUMMARY OF THE INVENTION

The present invention relates to a double-flow exhaust system for an internal-combustion engine, and more particularly, to an exhaust system having exhaust-gas-carrying pipes, and at least one muffler and catalyst housing.

DE 199 32 349 A1 shows a double-flow exhaust system of a motor vehicle in which two exhaust lines are guided together at the end into a common end muffler housing. A tail pipe, by way of which the exhaust gases are discharged to the outside, is fastened to the end muffler housing. As illustrated in FIG. 1 thereof, each exhaust line consists of several assemblies, such as the exhaust gas manifold, the catalyst and the end muffler which are assembled by way of corresponding exhaust pipes and flange-type connections.

An object of the present invention is to provide the assemblies of the exhaust system such that, on one hand, the free installation space in the area of the exhaust tail pipe is increased and, on the other hand, the mounting of the entire exhaust system is facilitated.

This object has been achieved by providing a separate end muffler for each exhaust line, the end mufflers being fluidically connected by at least one mountable connection pipe.

As a result of the fact that the two exhaust lines each have a separate end muffler, which both are fluidically connected by way of at least one mountable connection pipe, the space obtained between the two faces can be utilized for placing and developing the exhaust tail pipe. Furthermore, by separating the two exhaust lines in the area of the end muffler, the individual exhaust line can be assembled as a preassembled constructional unit in order to then complete it on the vehicle to form the entire exhaust system. By separating the U-shaped entire exhaust system in the area of the end muffler, a transport of the preassembled constructional unit also becomes possible without any problem.

A first connection of the two end mufflers takes place by way of a T-pipe piece which, via its two first pipe ends, is connected with the two end mufflers, while the third pipe end is used as an exhaust gas outlet. In this embodiment, a tail pipe with a tail pipe cover is mounted on the third pipe end of the T-piece.

Advantageously a second connection pipe between the two end mufflers contributes to the muffling of noise, particularly of the low-frequency fractions in the low rotational speed range. Simultaneously, a torque increase is obtained in the low rotational speed range. Here, the course and the position in the rotational speed band of the torque increase and of the noise muffling can be significantly influenced by the targeted adaptation of the pipe length and of the pipe cross-section.

The mountable second connection pipe consists of two connecting pieces connected with the respective end muffler housing, onto which connecting pieces a sliding sleeve is pushed and whose axial positioning or securing can be achieved, for example, by a clamp.

Other objects, advantages and novel features of the present invention will become apparent from the following detailed description of the invention when considered in conjunction with the accompanying drawings.

DETAILED DESCRIPTION OF THE DRAWINGS

Figure 1:
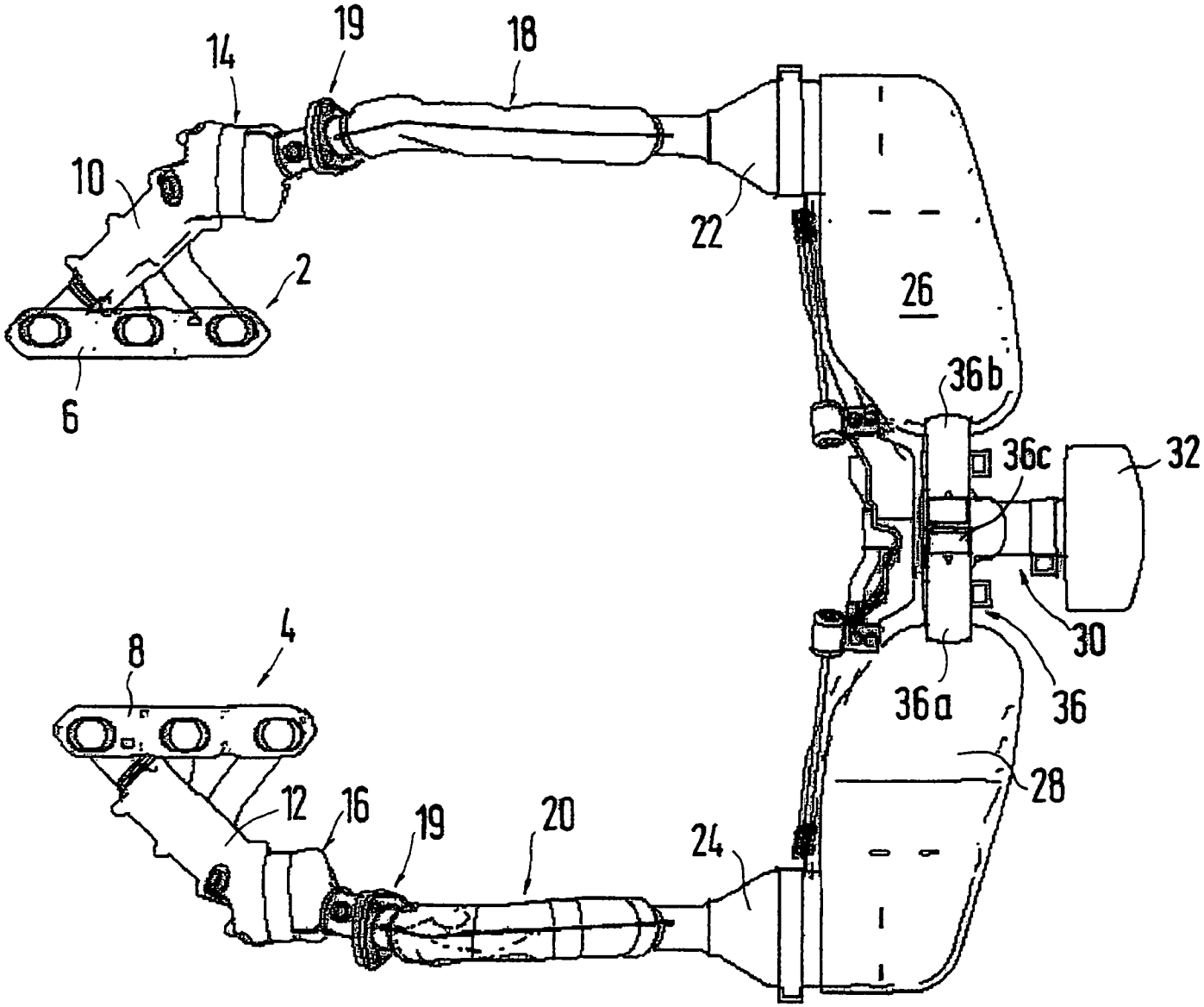
FIG. 1 is a top view of an exhaust system.
Figure 2:
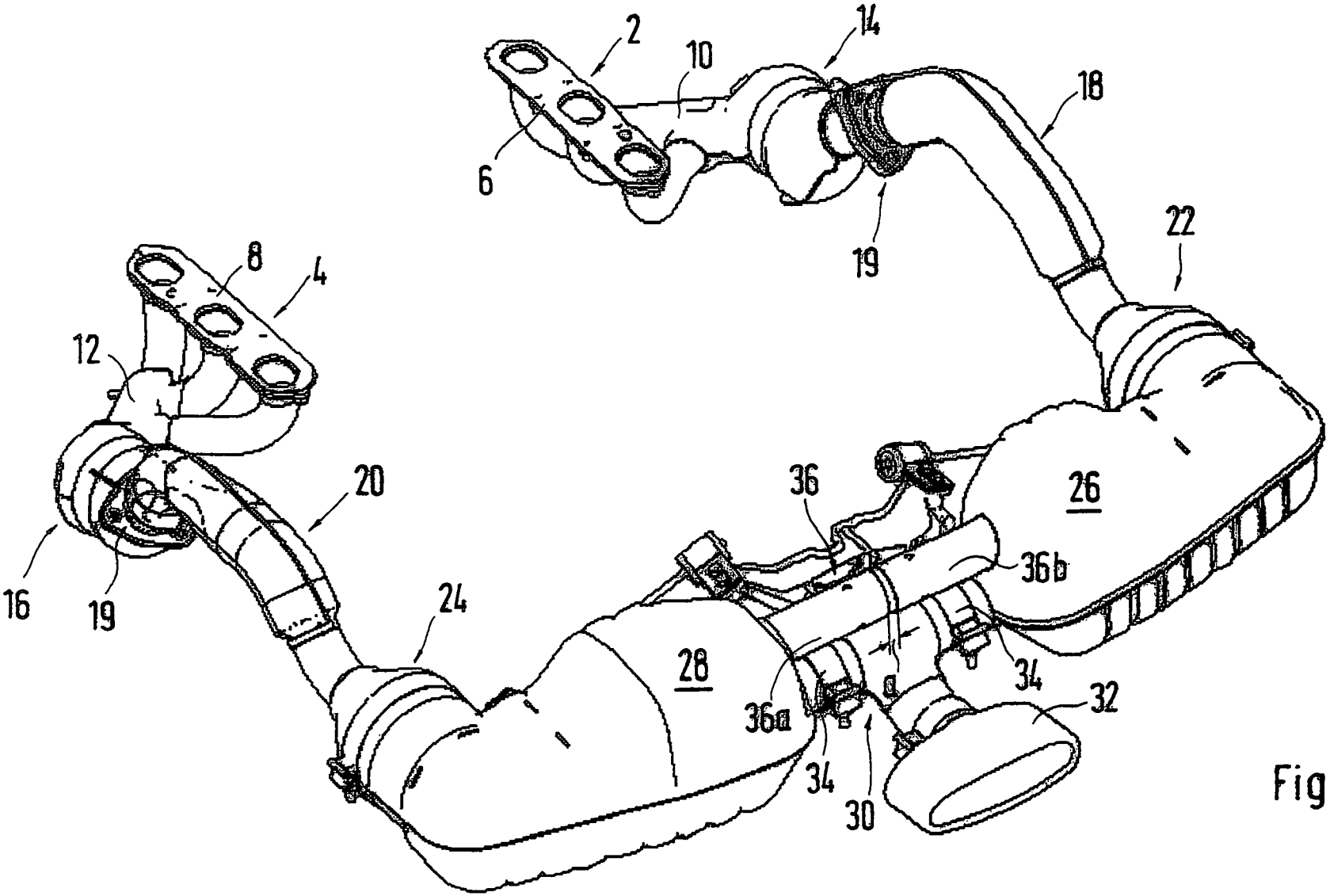
FIG. 2 is a perspective frontal view of the exhaust system of FIG. 1.

The double-flow exhaust system for a 6-cylinder engine has a respective exhaust manifold 2, 4 which is by its respective flange section 6, 8 on the cylinder head of an engine unit (not shown). The three individual pipes of the exhaust manifold 2 and 4 lead into one exhaust gas collecting pipe 10, 12 respectively which is adjoined by a housing 14, 16 respectively of a starting catalyst. Each exhaust pipe 18, 20 respectively is connected to the starting catalysts 14, 16 by a detachable flange connection 19, which exhaust pipes 18, 20 each lead to one housing 22, 24 respectively in which a main catalyst is accommodated. The main catalysts 22, 24 are each accommodated in an end muffler housing 26, 28 respectively or are partially integrated therein. Both end muffler housings 26, 28 are fluidically connected with one another by way of a first connection pipe designated generally by numeral 30, in the following description referred to as a lower connection pipe.

The lower connection pipe 30 is constructed as a T-pipe piece on whose free connecting piece an exhaust pipe cover 32 is fastened, while the connecting pieces are fitted onto a pipe connecting piece of the respective end muffler housing 26, 28 and are secured by two fastening clamps 34. A second connection pipe 36, in the following description referred to as an upper connection pipe 36, extends above the lower connection pipe 30 and consists of two connecting pieces 36*a*, 36*b* extending out of the respective end muffler housing 26, 28. The two ends of the connecting pieces 36*a*, 36*b* are spaced away from one another while being aligned with respect to one another on the face-side. The forming gap A is covered by a sliding sleeve 36*c*—(shown only in FIG. 1) which is axially secured by clamps (not shown). Thus, the two connecting pieces 36*a*, 36*b* and the mountable sliding sleeve 36*c* allow a second gastight connection to be established between the two end muffler housings 26 and 28 by way of the connection pipe 36.

Figure 3:
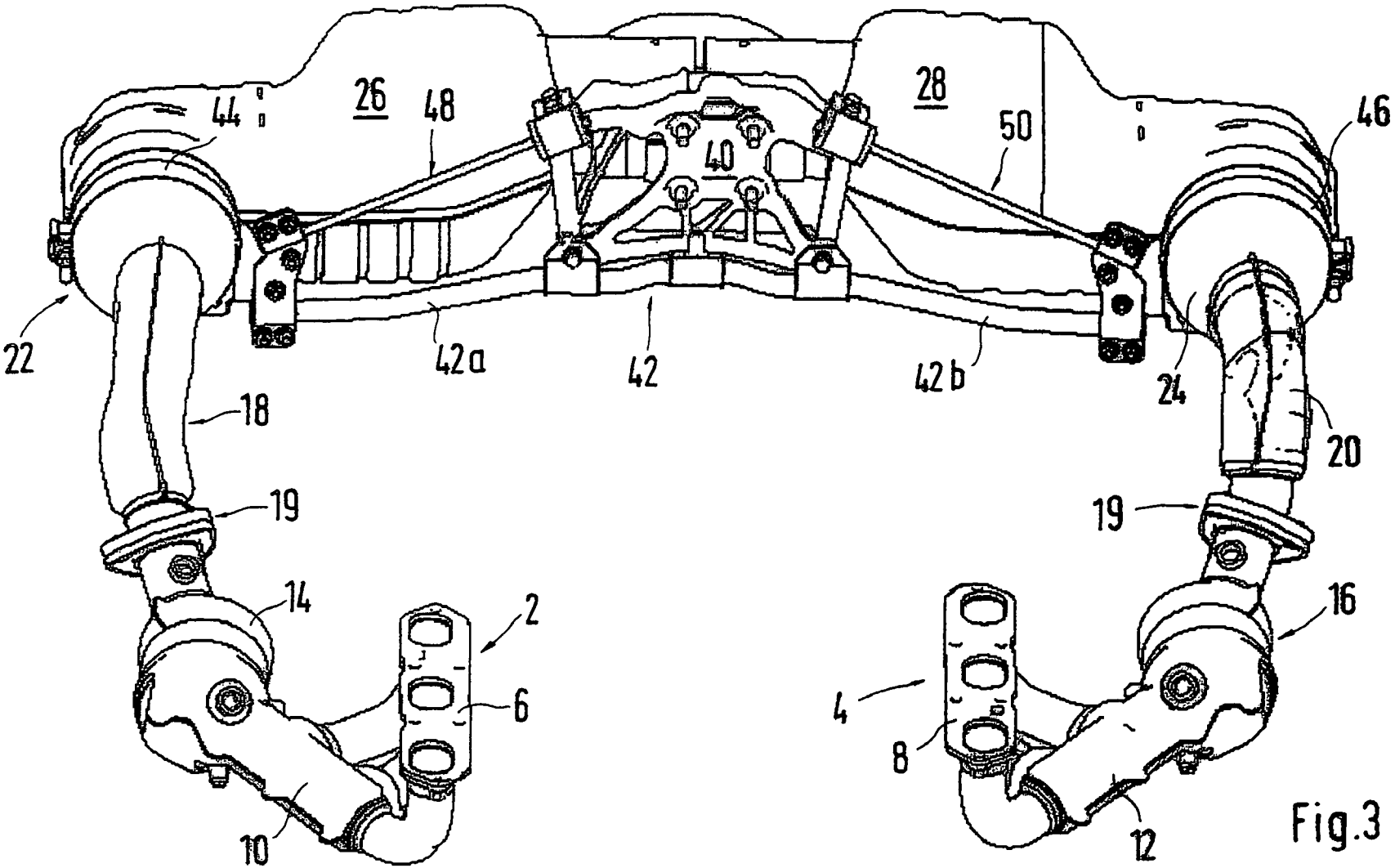
FIG. 3 is a perspective rear view of the exhaust system shown in FIGS. 1 and 2.

For the suspension or fastening of the entire exhaust system, a fastening device is provided which has a carrier plate 40 fastenable to a transmission as seen in FIG. 3. A lower pipe stay 42 is fastened to the carrier plate 40, to the left and right supporting leg 42*a*, 42*b* respectively of the pipe stay 42, one fastening clamp 44, 46 respectively being provided which reaches around the housing of the respective starting catalyst 14, 16. The lower pipe stay 42 is supported by two tension struts 48, 50 elastically disposed on the carrier plate 40.

The invention claimed is:

1. Double-flow exhaust system for an internal-combustion engine comprising:

two exhaust-gas-carrying pipes that are configured to receive gasses produced by the internal-combustion engine, at least one muffler and catalyst housing associated with each exhaust-gas-carrying pipe, each muffler including at least two ports extending therefrom, wherein each port of a muffler is provided for either receiving exhaust gases from another muffler or directing exhaust gases out of the muffler, a first removably mountable connection pipe for fluidically connecting the mufflers of the exhaust-gas-carrying pipes, wherein the first removably mountable connection pipe is a T-pipe that includes two inlet ports that are oriented along a common axis and an outlet port that is oriented substantially perpendicular to the common axis of the inlet ports, each inlet port of the first removably mountable connection pipe being configured to be removably mounted to a single port of a respective muffler to receive exhaust gases from the muffler, and said outlet port of said first removably mountable connection pipe being configured to discharge the exhaust gases to a location outside of the internal-combustion engine, and a second connection pipe for fluidically connecting the mufflers of the exhaust-gas-carrying pipes, wherein the second connection pipe includes two connecting pieces each extending out of a respective muffler housing, wherein end faces of the connecting pieces are separated by a gap that is covered by a joint sliding sleeve that is directly connected to the connecting pieces.

2. Double-flow exhaust system according to claim 1, wherein the T-pipe includes two connecting pieces, each of which includes one of the inlet ports and is connectable with a respective muffler, and a third connecting piece that defines the outlet port and is usable as a discharge for exhaust gases to outside the engine.

3. Double-flow exhaust system according to claim 2, wherein a tail pipe cover is mountable on the third connecting piece.

4. Double-flow exhaust system according to claim 1, wherein a catalyst is provided for each exhaust line, and is partially integrated or received in a muffler housing.

5. Double-flow exhaust system according to claim 4, wherein the T-pipe includes two connecting pieces, each of which includes one of the inlet ports and is connectable with a respective muffler, and a third connecting piece that defines the outlet port and is usable as a discharge for exhaust gases to outside the engine.

6. Double-flow exhaust system according to claim 5, wherein a tail pipe cover is mountable on the third connecting piece.

7. A method of assembling a double-flow exhaust system for an internal-combustion engine including two exhaust-gas-carrying pipes that are configured to receive gasses produced by the internal-combustion engine, and at least one muffler and catalyst housing associated with each exhaust-gas-carrying pipe, said method comprising the steps of:

coupling a first inlet port of a first removably mountable connection pipe to a first port defined in a muffler of a first exhaust-gas-carrying pipe;

coupling a second inlet port of the first removably mountable connection pipe to a first port defined in a muffler of a second exhaust-gas-carrying pipe such that the inlet ports of the first removably mountable connection pipe are oriented along a single common axis;

positioning an outlet port of the first removably mountable connection pipe such that exhaust gases produced by the internal-combustion engine are discharged to a location outside of the internal-combustion engine;

coupling a first end of a sleeve to a second port defined in the muffler of the first exhaust-gas-carrying pipe; and coupling a second end of the sleeve to a second port defined in the muffler of the second exhaust-gas-carrying pipe to muffle noise created by the internal combustion engine.

* * * * *